US008973211B2

(12) United States Patent
Rote et al.

(10) Patent No.: US 8,973,211 B2
(45) Date of Patent: Mar. 10, 2015

(54) DETECTOR CLEANER AND/OR TESTER AND METHOD OF USING SAME

(75) Inventors: Scott Rote, New Lenox, IL (US); Dan Johnson, Chicago, IL (US); Aaron B. Eiger, Chicago, IL (US)

(73) Assignee: HSI Fire & Safety Group, LLC, Elk Grove Village, IL (US)

( * ) Notice: Subject to any disclaimer, the term of this patent is extended or adjusted under 35 U.S.C. 154(b) by 154 days.

(21) Appl. No.: 13/366,309

(22) Filed: Feb. 4, 2012

(65) Prior Publication Data

US 2013/0199260 A1 Aug. 8, 2013

(51) Int. Cl.

| | |
|---|---|
| ***A47L 5/14*** | (2006.01) |
| ***G08B 29/14*** | (2006.01) |
| ***G08B 29/12*** | (2006.01) |

(52) U.S. Cl.

CPC ..... *G08B 29/145* (2013.01); *G08B 29/126* (2013.01)

USPC ..... 15/345; 15/404; 73/865.9; 73/1.06

(58) Field of Classification Search

CPC ..... G08B 29/145; A47L 9/08; A47L 5/14

USPC ..... 73/865.9, 1.06; 15/345

See application file for complete search history.

(56) References Cited

U.S. PATENT DOCUMENTS

| | | | | |
|---|---|---|---|---|
| 4,301,674 | A | | 11/1981 | Haines et al. |
| 4,315,344 | A | | 2/1982 | Woodward et al. |
| 4,333,205 | A | * | 6/1982 | Woodward et al. ..... 15/345 |
| 4,462,244 | A | | 7/1984 | Lee |
| 5,139,699 | A | | 8/1992 | Cooper et al. |
| 5,170,148 | A | * | 12/1992 | Duggan et al. ..... 340/515 |
| 5,361,623 | A | | 11/1994 | Wantz |
| 5,611,620 | A | | 3/1997 | Wantz |
| 5,670,946 | A | * | 9/1997 | Ellwood et al. ..... 340/628 |
| 5,785,891 | A | | 7/1998 | Lim |
| 5,959,188 | A | | 9/1999 | Deutsch et al. |
| 6,015,230 | A | | 1/2000 | Wantz et al. |
| 6,143,090 | A | | 11/2000 | Lietz |
| 6,282,940 | B1 | | 9/2001 | Hung et al. |

(Continued)

FOREIGN PATENT DOCUMENTS

| | | | |
|---|---|---|---|
| CN | 201161246 Y | | 12/2008 |
| CN | 201161246 Y | * | 12/2008 |

(Continued)

OTHER PUBLICATIONS

International Search Report and Written Opinion for International Application No. PCT/US2013/024286 mailed May 7, 2013 (14 pages).

(Continued)

*Primary Examiner* — Bryan R Muller

(74) *Attorney, Agent, or Firm* — McDonnell Boehnen Hulbert & Berghoff LLP

(57) ABSTRACT

An apparatus for cleaning a detector comprising a housing and a bowl connected to the housing having a detector chamber adapted for enclosing a detector to be cleaned, a contacting surface positioned on the bowl, and one of more air nozzles positioned within the detector chamber for directing one or more bursts of compressed air at a detector to clean the detector, and a fan positioned within the housing operable to draw air within the detector chamber into a filter, and a dust collector for containing dirt and debris dislodged from a detector during the cleaning operation.

47 Claims, 7 Drawing Sheets

(56) References Cited

U.S. PATENT DOCUMENTS

| | | | | |
|---|---|---|---|---|
| 6,423,962 | B1 | 7/2002 | Pepper | |
| 6,591,716 | B2 | 7/2003 | Wantz | |
| 6,640,608 | B2 | 11/2003 | Pepper et al. | |
| 6,741,181 | B2 | 5/2004 | Skaggs | |
| 6,769,285 | B2 * | 8/2004 | Schneider et al. | 73/1.06 |
| 6,875,373 | B2 | 4/2005 | Elendu | |
| 6,995,678 | B2 | 2/2006 | Wey | |
| D518,341 | S | 4/2006 | Lowen | |
| D519,338 | S | 4/2006 | Lowen | |
| 7,167,098 | B2 | 1/2007 | Siber et al. | |
| 7,212,734 | B2 | 5/2007 | Pepper et al. | |
| D558,549 | S | 1/2008 | Ozaki-Owen | |
| 7,320,735 | B2 | 1/2008 | Riske | |
| 7,377,147 | B1 | 5/2008 | Scheffler et al. | |
| 7,497,108 | B2 | 3/2009 | Scheffler | |
| 7,587,926 | B2 * | 9/2009 | Ackerman | 73/1.02 |
| D611,122 | S | 3/2010 | Rossiter et al. | |
| 7,703,344 | B2 | 4/2010 | MacPherson, III et al. | |
| 7,805,974 | B2 | 10/2010 | Scheffler et al. | |
| 7,852,227 | B2 | 12/2010 | Pepper et al. | |
| 7,878,079 | B2 | 2/2011 | Goodwin | |
| 8,049,612 | B2 | 11/2011 | Pepper | |
| 8,205,478 | B1 * | 6/2012 | Hallisey | 73/1.06 |
| 2002/0166361 | A1 | 11/2002 | Wantz et al. | |
| 2004/0050137 | A1 | 3/2004 | Hoppenworth | |
| 2007/0186618 | A1 | 8/2007 | Ackerman | |
| 2009/0211382 | A1 * | 8/2009 | Feiter | 73/865.9 |

FOREIGN PATENT DOCUMENTS

| | | |
|---|---|---|
| EP | 1548676 | 12/2004 |
| EP | 1 548 676 | 6/2005 |
| GB | 2 432 703 | 5/2007 |
| KR | 988386 | 10/2010 |
| WO | 94/25946 | 11/1994 |
| WO | 2007/138329 | 12/2007 |
| WO | 2008/111895 | 9/2008 |

OTHER PUBLICATIONS

Feiter, Margaret A. et al., U.S. Appl. No. 13/251,919 entitled "Heat Detector Test" filed Oct. 3, 2011, 21 pages.

* cited by examiner

DETECTOR CLEANER AND/OR TESTER AND METHOD OF USING SAME

BACKGROUND

The present invention generally relates to a device for cleaning and/or testing a detector and a method of using such a device for cleaning and/or testing a detector. The device and method are particularly well suited for cleaning a detector, such as a detector for detecting the presence of carbon monoxide, smoke, or heat. The device and method are also designed for testing a carbon monoxide detector or a smoke detector.

The use of various types of detectors has become widespread. For example, carbon monoxide detectors, smoke detectors, and heat detectors are commonly used in commercial and residential buildings, recreational vehicles, mobile homes, as well as boats. The use of such detectors is even required by law to be installed in some jurisdictions. The lifespan of the various detectors has also increased over time. As a result, detectors are often used for longer periods of time before they are replaced. Over time, detectors may become dirty as dust or other debris accumulates. The operational capability of the detectors may be reduced or compromised as a result. Thus, there is a need to provide a device and method for cleaning the various types of detectors that are used.

In addition, carbon monoxide detectors, smoke detectors, and heat detectors are often placed in areas that require a very clean environment. For example, in hospitals, laboratories, and sophisticated manufacturing and assembly facilities it may be important that any dust or debris dislodged or removed from the detectors during a cleaning operation does not contaminate the environment. Thus, for example, in "clean room" applications, it desirable that any dust and debris dislodged during the cleaning of the detectors is captured and prevented from contaminating the environment. Thus, there is a need to provide a device and method for cleaning the various types of detectors that are used that includes means for capturing any dust or debris that is dislodged from the detector during the cleaning operation to help prevent contamination of the environment.

Furthermore, many detectors include a button that may be depressed to test and verify that that the circuitry of the detector is working properly, or that the batteries are sufficiently charged. However, it is also desirable to check that the carbon monoxide and/or smoke detecting capability of the detectors is still working properly as well. Thus, there is a need to provide a device and method for testing the carbon monoxide and/or smoke detecting capabilities of the various detectors to see if they are properly working.

In addition, detectors come in various shapes and sizes. Some are circular, some are rectangular, some extend further from the mounting surface, etc. Therefore, it is desirable to provide a detector cleaner and/or tester that may accommodate a range of detector shapes and sizes.

SUMMARY

The present embodiments disclose an apparatus for cleaning a detector comprising a housing and a bowl connected to the housing having a detector chamber adapted for enclosing a detector to be cleaned, a contacting surface positioned on the bowl, and one of more air nozzles positioned within the detector chamber for directing one or more bursts of compressed air at a detector to clean the detector, and a fan positioned within the housing operable to draw air within the detector chamber into a filter, and a dust collector for containing dirt and debris dislodged from a detector during the cleaning operation.

Further embodiments include a test container receptor within the housing adapted for receiving a container of test gas where test gas is released from the container of test gas and passes through a chimney into the detector chamber.

Example embodiments also disclose a method of cleaning a detector comprising the steps of positioning a detector chamber of a bowl attached to a housing over a detector to be cleaned, pressing a contacting surface positioned on the detector chamber against a surface to which the detector is positioned, discharging one or more bursts of compressed air through one or more nozzles positioned in the detector chamber towards the detector to clean dust or debris from the detector, operating a fan to draw air from the detector chamber into a filter, and collecting dust or debris dislodged from the detector in a dust bin.

Further embodiments disclose the additional step of releasing a test gas into the detector chamber, and operating a fan to remove test gas from the detection chamber and into the air filter.

An additional example embodiment is directed to a method including the steps of positioning a detector chamber of a bowl attached to a housing over a detector to be cleaned, discharging one or more bursts of compressed air through one or more nozzles positioned in the detector chamber towards the detector to clean dust or debris from the detector, operating a fan to draw air from the detector chamber into a filter, releasing test gas into the detector chamber; and operating a fan to draw the test gas from the detector chamber into the filter.

An additional example embodiment is directed to an apparatus for testing a detector that includes a housing, a bowl connected to the housing having a detector chamber adapted for enclosing a detector to be tested, a contacting surface positioned on the bowl, a passageway within the housing for test gas to enter the detector chamber, and a fan positioned within the housing operable to draw test gas from the detector chamber into a filter.

BRIEF DESCRIPTION OF THE DRAWINGS

Exemplary embodiments are described herein with reference to the drawings, wherein like parts are designated by like reference numerals, and wherein.

DETAILED DESCRIPTION OF THE INVENTION

Figure 1:
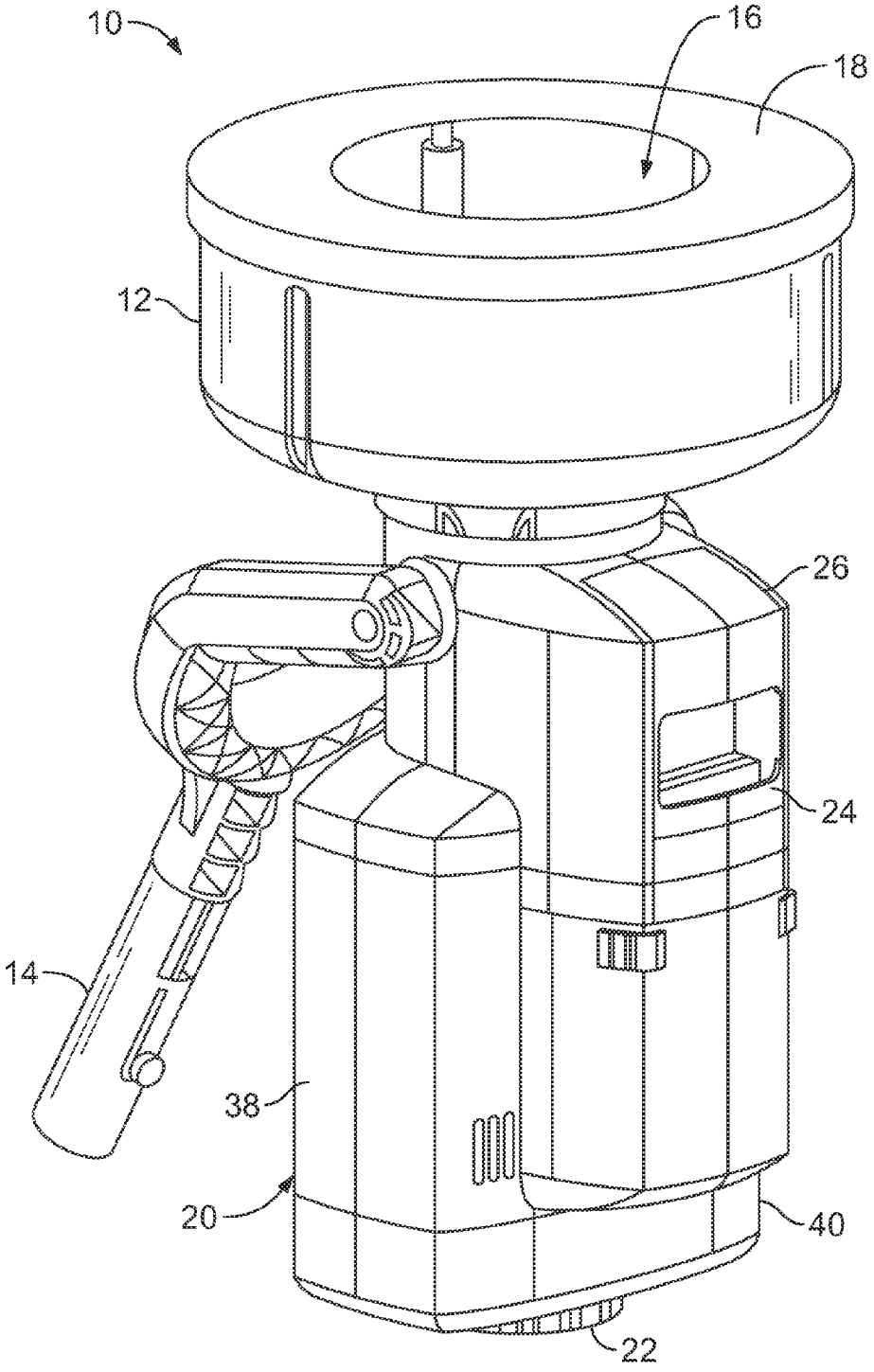
FIG. 1 is a perspective view of a detector cleaning and/or testing device 10.

FIG. 1 is a perspective view of a detector cleaning and/or testing device 10. Device 10 includes a housing 20. The housing 20 is comprised of a main housing 38, an upper housing 26, and a bottom 40. A bowl or cup 12 is connected to the upper housing 26. The bowl 12 includes a detector chamber 16 that is sized to enclose a detector that is to be cleaned or tested. The bowl 12 includes contacting surface 18 that is designed for placement against a wall or ceiling during the cleaning or testing operation. Preferably the contacting surface 18 is comprised of a flexible, rubbery material such as silicone rubber or santoprene so that a seal may be formed around the detector between the bowl and the surface, ceiling or wall, where the detector is located. Device 10 also includes a handle 14 that is attached to the housing 20, and is shown pivotally mounted to upper housing 26. The handle 14 is adapted to receive a pole or other device to enable the device 10 to be positioned over a detector located on a ceiling. Housing 20 also includes a removable dust drawer 24 positioned in the upper housing 26 that serves to collect dust and debris that is dislodged during the cleaning operation. The handle 14, housing 20, and bowl 12 are preferably comprised of a durable, lightweight material such as a hard plastic, such as a polycarbonate. In a preferred embodiment, the handle 14 is comprised of glass-filled nylon, the components of housing 20 are comprised of ABS (acrylonitrile butadiene styrene, and bowl 12 is comprised of a polycarbonate having the trade name Lexan. In addition, the bowl 12 may be made from a translucent material so that the detector being cleaned or tested may be visible during the cleaning or testing process.

The detector chamber 16 is sized so that the bowl 12 may enclose a variety of the commonly used carbon monoxide detectors, smoke detectors, and heat detectors on the market. In FIG. 1, the detector chamber 16 is shown to have a round shape having a diameter of 8.5 inches, which is suitable to enclose the size of many round detectors found on the market. However, the shape of the bowl 12 or detector chamber 16 is not limited to a round shape, and may take any desired geometric shape, such as a square, rectangle, polygon, oval, etc.

Figure 2:
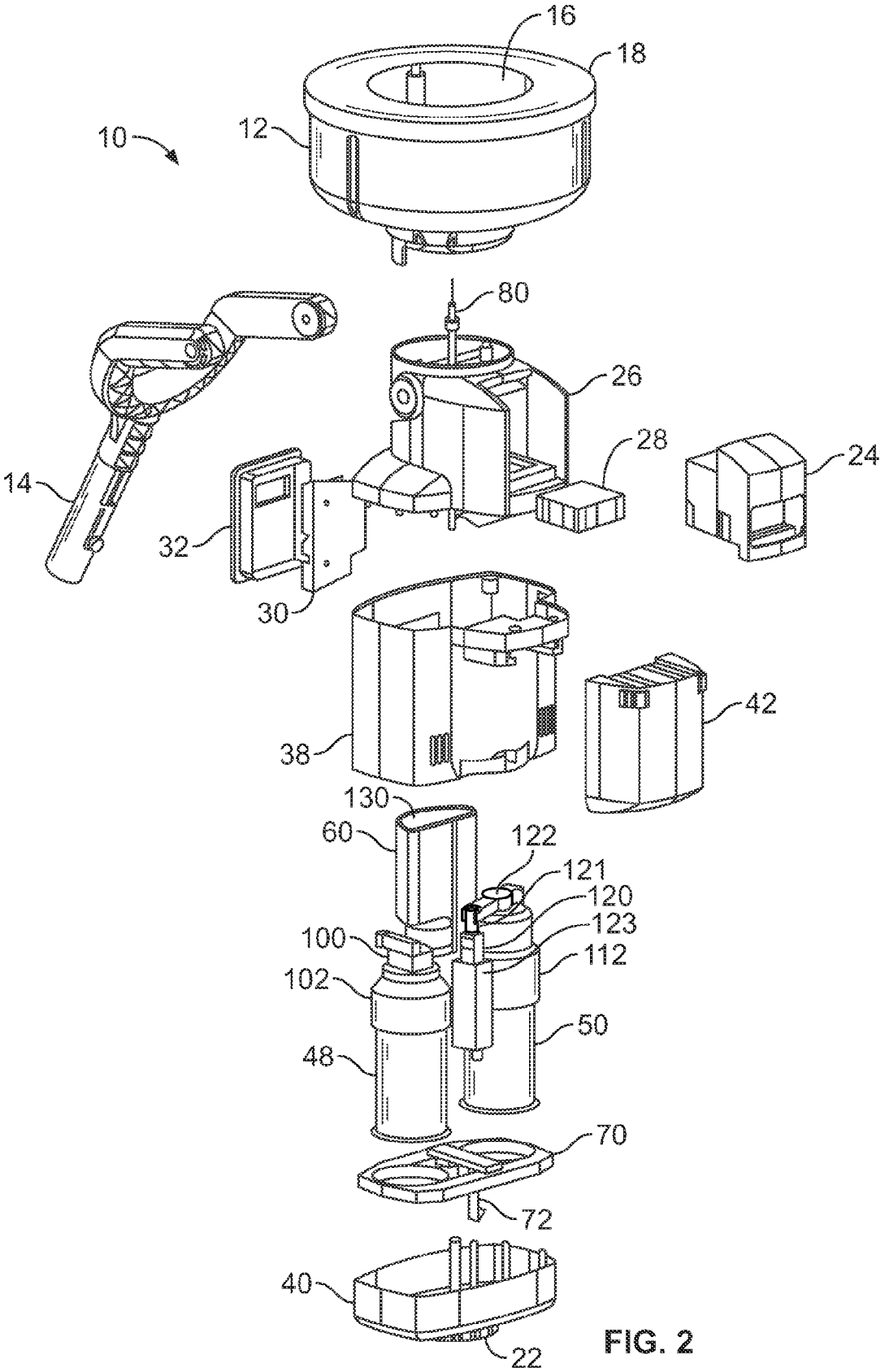
FIG. 2 is an exploded view of the detector cleaning and/or testing device shown in FIG. 1.

FIG. 2 shows an exploded view of the detector cleaning and/or testing device 10 shown in FIG. 1. Device 10 includes a bowl 12 and a detector chamber 16 that is designed to enclose a detector to be cleaned and/or tested. Bowl 12 includes mounting surface 18 that is designed to engage the ceiling or wall where the detector is located. Positioned within upper housing 26 is an air nozzle 80. Air nozzle 80 is used to clean a detector positioned within the detector chamber 16 by delivering a burst of compressed air towards the detector to dislodge any dirt or debris that may have accumulated on the detector. Upper housing 26 also includes dust drawer 24 with a fan 28 positioned underneath the dust drawer 24. An air filter (not shown) is also positioned within the dust drawer 24 above the fan 28. During operation, the fan serves to create a vacuum to draw air and any dust or debris that is dislodged during a cleaning operation into the filter. The dust drawer 24 serves to contain the dust and debris that is dislodged during cleaning which helps to prevent contaminating the area where the detector is located. In this manner, the device serves as a self-contained cleaning unit that is able to both clean a detector and contain any dirt or debris that is dislodged during the cleaning operation.

Main housing 38 includes a battery pack 42 that is used to power the detector cleaning and/or testing device 10. Battery pack 42 is removably positioned on main housing 38 so that the battery pack 42 may be easily accessed or replaced. In a preferred embodiment, the battery pack 42 is a 25.2 volt lithium ion battery pack. The device 10 is controlled by control panel 32 and printed circuit board 30 positioned on main housing 38. Also positioned within main housing 38 is compressed air canister 48 and test canister 50 which may contain a test gas for a carbon monoxide tester or a test gas for a smoke detector. For example, test canister 50 may contain COCheck carbon monoxide test gas or SmokeCheck smoke detector test gas available from HSI Fire & Safety Group of Elk Grove Village, Ill. However, any test gas suitable for testing the operation of a carbon monoxide detector or a smoke detector may be used. Moreover, compressed air canister 48 and test canister 50 are shown as cylindrical canisters, they could be a container of any suitable shape.

In addition, it is also contemplated that the compressed air could be provided by an external source. For example, instead of a container of compressed air, an accumulator could be positioned within the housing and an external pump could be used to periodically pressurize the accumulator. In this manner, pressurized air from the accumulator could be directed to the air nozzles. Alternately, an air compressor or air pump could be used to deliver compressed air to the detector cleaning and/or testing device 10. For example, a port could be positioned on the housing to which a connector at the end of a hose could be used to deliver compressed air to the device 10 from an air compressor or air pump. An air hose with a quick disconnect fitting could be used to connect the air compressor to the device 10 to deliver the compressed air for the cleaning operation. In addition, the test gas, whether containing carbon monoxide, or containing smoke or synthetic smoke could also be provided by an external source. For example a container of test gas could be connected to the cleaning and/or testing device test to deliver test gas to the detector chamber 16. Thus, the cleaning and/or testing device could be operated without having containers of compressed air or test gas positioned therein, as the compressed air or test gas used for the cleaning and testing operations could be provided from a source external to device 10.

As shown in FIG. 2, compressed air canister 48 is retained within receptor 102 and test canister 50 is positioned within receptor 112. Receptor 102 includes female threads that mate with corresponding male threads positioned on the top of compressed air canister 48. Thus, compressed air canister 48 is maintained in position by virtue of being threadingly engaged with receptor 102. Also shown in FIG. 2 is retainer 70 that generally retains the compressed air canister 48 and test canister 50 in proper alignment. Latch 72 extends from retainer 70 and fits over the bottom of test canister 50 to retain test canister 50 in proper position with respect to receptor 112. Knob 22 has a threaded portion that engages retainer 70 to retain bottom 40 of the housing in place. Thus, access to the canisters 48 and 50 may easily be achieved by unscrewing knob 22 to remove the bottom 40. The removable bottom 40 provides ready access to canisters 48 and 50 if they need to be replaced. Alternately, a quarter turn fastener that rotates 90 degrees could be used to secure the removable bottom 40. Other alternatives also exist for accessing the canisters 48 and 50 including a pair of side opening doors, or a door that opens to the side, up, or down, etc.

A linear actuator 120 is positioned within pocket 123 located on receptor 112 and includes an arm 121 that is connected to level 122 and is used to release carbon monoxide test gas or test gas for a smoke detector from test canister 50 and through passageway 130 of chimney 60 that extends from receptor 112. Passageway 130 provides a pathway between test canister 50 and detector chamber 16 so that the carbon monoxide test gas or test gas for a smoke detector may be provided in the vicinity of the detector to be tested. In this manner, the detecting capability of a carbon monoxide detector or a smoke detector may be tested.

Figure 3:
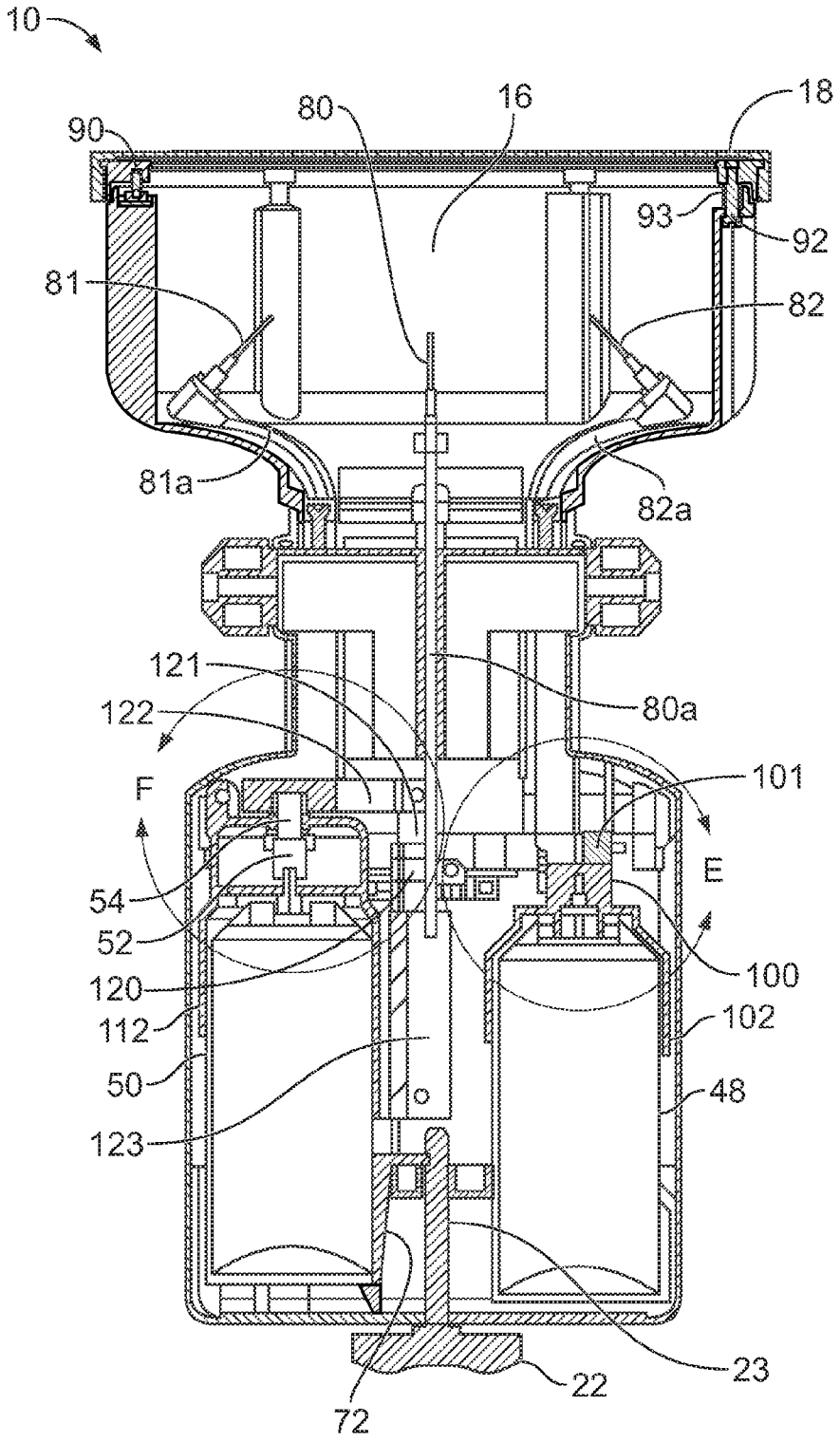
FIG. 3 is a cut away view of the detector cleaning and/or testing device shown in FIGS. 1 and 2.
Figure 7A:
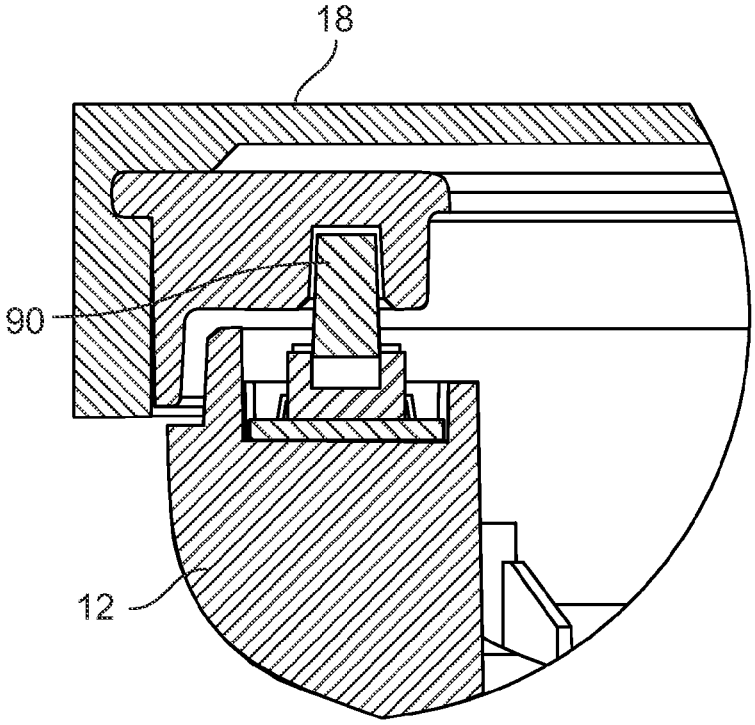
FIG. 7A is an enlarged view of an upper left section of FIG. 3.
Figure 7B:
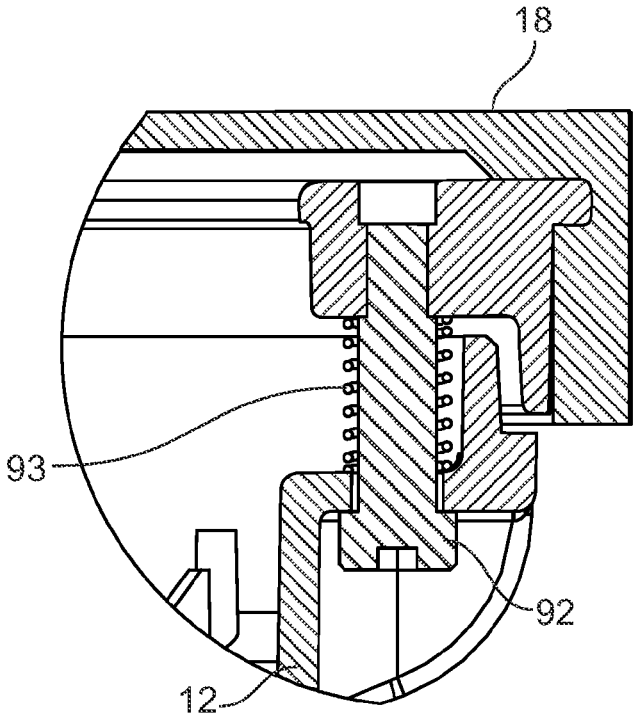
FIG. 7B is an enlarged view of an upper right section of FIG. 3.

FIG. 3 shows a different cross-sectional view of the detector cleaning and/or testing device 10 shown in FIGS. 1 and 2. FIG. 3 shows that a contact switch 90 is positioned beneath the contacting surface 18. A shoulder bolt 92 is also positioned beneath the contacting surface 18. A spring 93 is positioned over the shoulder bolt 92 and normally biases the contacting surface 18 away from the contact switch 90. When the contacting surface 18 is brought into contact against a ceiling or wall when cleaning or testing a detector, the spring 93 positioned over the shoulder bolt 92 is loaded and depressed, and the contacting surface travels on the order of 20 thousandths of an inch before the contact switch 90 is activated. A more detailed cross-sectional view of the top of the device showing contacting surface 18, contact switch 90, shoulder bolt 92 and spring 93 is shown in FIGS. 7A and 7B. In particular, FIG. 7A shows contact switch 90 positioned beneath contacting surface 18 and FIG. 7B shows how contacting surface 18 is connected to bowl 12 via shoulder bolt 92, and also shows spring 93 positioned over shoulder bolt 92 to normally bias contacting surface 18 away from contact switch 90. The activation of contact switch 90 places the detector cleaning and/or testing device 10 in a ready mode where it is ready to begin a cleaning or testing operation.

To operate the cleaning and/or testing device 10, the control panel 32 includes a power button to turn on the power to device 10. At this point, a user may select a number of different modes of operation. For example, a clean only mode, a test only mode, or a clean and test mode may be selected. For the clean mode, a heavy clean mode or normal clean mode may also be selected. Furthermore, a button for testing either a carbon monoxide detector or a test for a smoke detector may be selected. A start button may be used included to commence the clean and/or test mode of the device. The control panel may also include an indicator showing how much battery life remains.

In the cleaning mode of operation, when the cleaning operation begins, the fan operates to pull the air within the detector chamber through the air filter. Next, the solenoid valve is energized to open the manifold and release compressed air through the nozzle in one or more bursts directed towards the detector within the detector chamber to dislodge dust and debris that may have accumulated on the detector. It is contemplated that the one or more bursts of compressed air may preferably have a duration of up to 1 second. Each burst could be of varying duration, and any number of desired bursts could be employed. The fan may continue to run for 5 to 10 seconds to pull any dust or debris dislodged by the bursts of compressed air into the filter. In the test mode of operation, the test gas is released by operating the linear actuator to depress the aerosol trigger for a desired duration to deliver test gas to the detector chamber. The duration of time the aerosol trigger is depressed may depend on which test gas is being released. For example, when testing a smoke detector, the aerosol trigger may only need to be depressed for a 0.5 to 1 second, whereas when testing a carbon monoxide detector, the aerosol trigger may be depressed for up to 2 or 3 seconds.

When the cleaning and/or testing device 10 is removed from over the detector being tested, the test is completed. Next, the fan is operated to draw the test gas through the filter. When clean and test mode is selected, the clean mode is run, followed by the test mode. In one contemplated embodiment, the clean mode is performed by directed one or more blasts of compressed air towards the detector and the detector chamber is then cleared by having the fan draw air and any dust and debris dislodged by the compressed air blasts through the filter. Next, the test is performed by releasing test gas into the detector chamber. After the test, the test gas is drawn through the air filter to remove the test gas from the detector chamber. The test gas may be cleared once the test is completed, or after a predetermined period time, e.g., after one minute. Alternately, the test gas may be cleared automatically once contact between the contacting surface and the contact switch is broken, which may include a delay, for example, a one second period of lack of contact before automatically clearing the detector chamber of test gas. Thus, the device may be used to perform clean, test, and clear functions.

Figure 4:
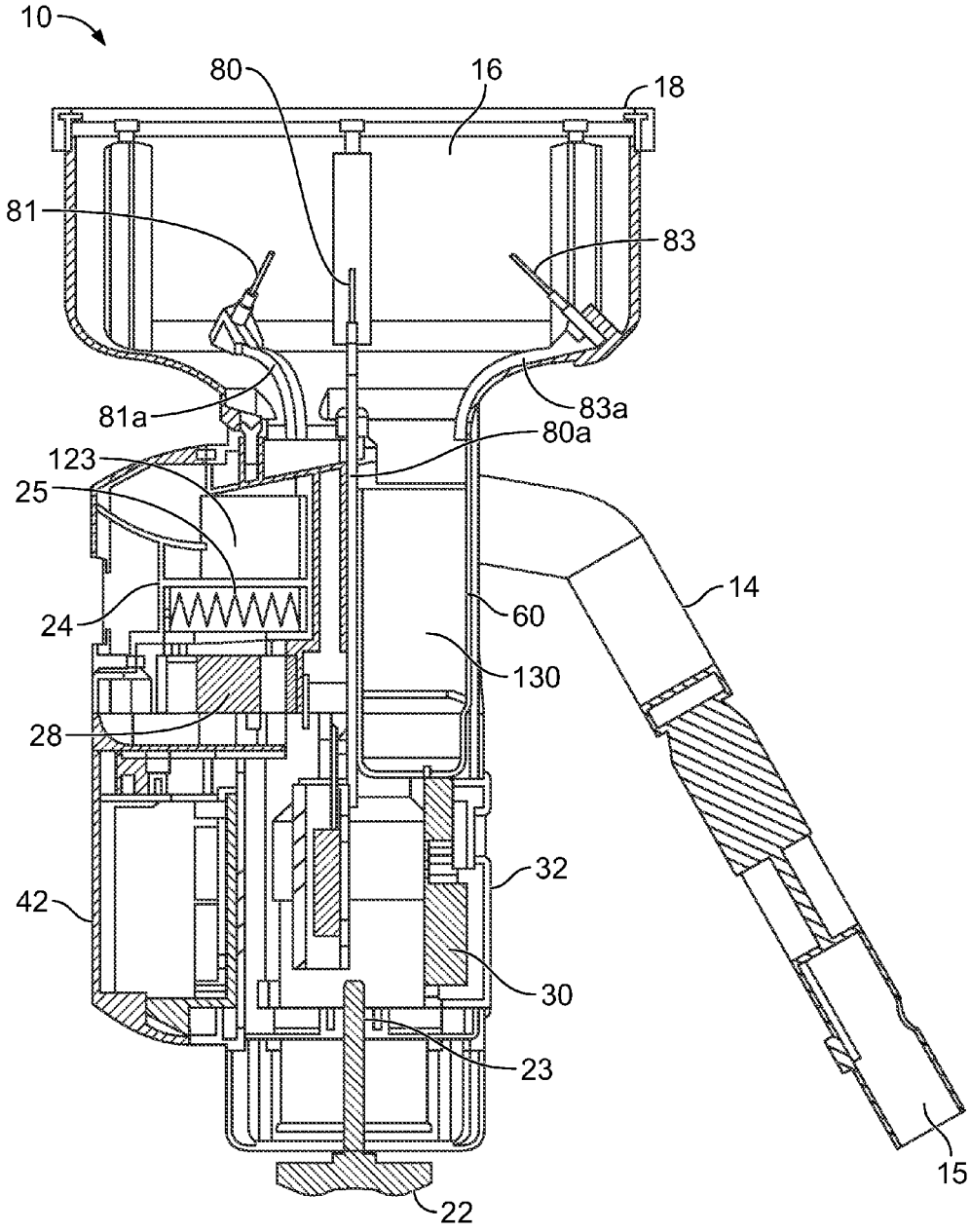
FIG. 4 is another cut away view of the detector cleaning and/or testing device shown in FIGS. 1-3.

Initially, the fan 28 shown in FIG. 2 may be turned on for five seconds to clear the test chamber and provide a vacuum to draw air through an air filter 25 (shown in FIG. 4). When normal clean mode is selected, a series of 3 bursts of compressed air each lasting around one half second, i.e., plus or minus 20%, may be directed through air nozzles 80, 81, 82, and 83 towards the detector positioned within the detector chamber 18. Any dust or debris that is dislodged from the detector during the cleaning operation is drawn by the fan 28 into the air filter 25 and collected in the dust drawer 24 (shown in FIG. 4). In a preferred embodiment, under normal clean mode operation, three bursts of compressed air each lasting around a half second are simultaneously directed through air nozzles 80, 81, 82, and 83 towards a detector in the detector chamber 18 to clean the detector. However, the air bursts could also be sequentially performed, could be of a longer or shorter duration, and a greater or lesser number of air bursts could be also be provided. Nonetheless, the level of cleaning obtained using around three half second bursts simultaneously directed through the air nozzles towards a detector in the detector chamber 18 has proven to provide a sufficient level of cleaning for a detector. In heavy clean mode, the normal clean mode could be repeated or additional series of burst of compressed air could be used.

In test mode, test gas for either a carbon monoxide detector or a smoke detector is released from the test canister 50 and travels to detector chamber 16 to test the operational capability of the detector within the detector chamber 16. In order to conduct the proper test, the test canister 50 should include the appropriate test gas. For example, when testing a carbon monoxide detector, the test gas within test canister 50 should contain carbon monoxide. When testing a smoke detector, the gas within test canister 50 should contain smoke or synthetic smoke. A user of the device may simply use a test canister 50 containing carbon monoxide when testing a carbon monoxide tester, and remove that test canister and replace it with a test canister containing smoke or synthetic smoke when it is desired to test a smoke detector. Optionally, the cleaning and/or testing device 10 could contain both a test canister with gas containing carbon monoxide and a test canister containing smoke or synthetic smoke. Thus, cleaning and/or testing device could contain a canister of compressed air, a canister of test gas containing carbon monoxide, and a canister of test gas containing smoke or synthetic smoke. Alternately, device 10 could contain any combination of two canisters, or contain only of the canisters.

In the view shown in FIG. 3, compressed air nozzle 80 is shown centrally located within the detector chamber 16. Additional air nozzles 81 and 82 are also shown positioned at the bottom of detector chamber and directed towards the center of the detector chamber 16 at an angle of approximately 45 degrees. Alternate angles, including or example 30 degrees and 60 degrees are also contemplated. In the embodiments shown, there are four nozzles that are used to deliver bursts of compressed air towards a detector during a cleaning operation. Nozzle 80 is positioned directly below the detector to be cleaned and nozzles 81, 82, and 83 (not shown) are spaced apart from each other 120 degrees from one another, and positioned generally below and to the side of the detector to be cleaned. Compressed air from compressed air canister 48 is delivered to air nozzles 80, 81, 82 and 83 (not shown) through passageways 80*a*, 81*a*, 82*a*, and 83*a* (not shown).

These passageways could be in the form of flexible hoses that extend from the compressed air canister 48 to the air nozzles.

It is contemplated that the location, positioning, and number of the air nozzles may be changed. For example, the air nozzles could all be positioned on one side of the detector chamber, or positioned beneath the detector, or positioned at an angle perpendicular to the detector. In addition, only a single air nozzle could be used, or additional air nozzles added. However, testing has revealed that the particular configuration of the four air nozzles shown in FIGS. 1-3 provides for a good cleaning effect. The air nozzles that are shown may be obtained from Henkel Corporation, having part number 97230. However, any air nozzle or orifice with the capability of delivering a burst of compressed air towards a detector in the detector chamber may be used.

Figure 6:
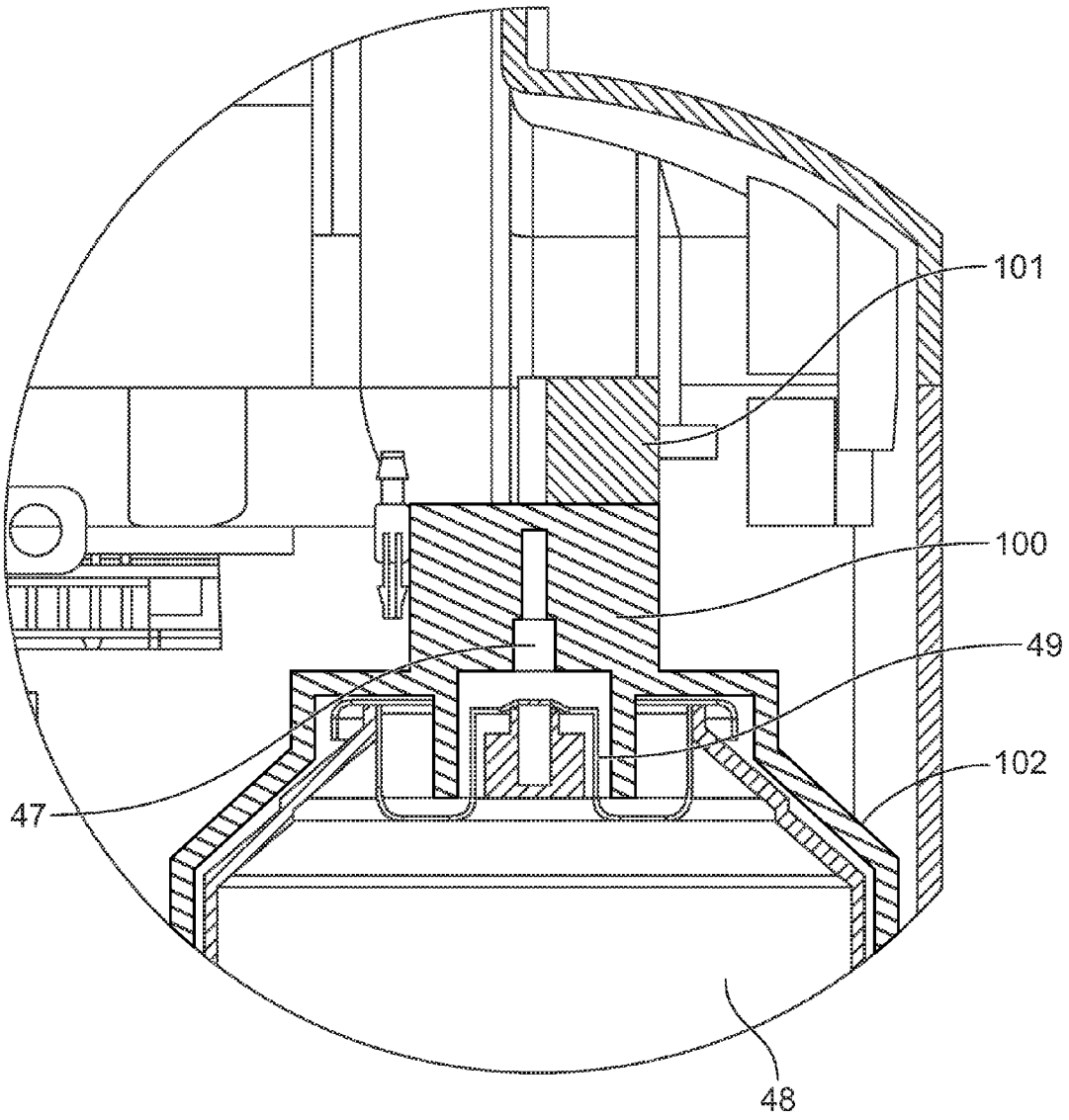
FIG. 6 is an enlarged view of circle E shown in FIG. 3.

FIG. 3 illustrates how the threaded portion 23 of knob 22 engages the retainer 70 and barb 72 extends beneath test canister 50 to hold it in place. FIG. 3 includes encircled portion E that is shown in enlarged form in FIG. 6. As shown in FIGS. 3 and 6, a male threaded portion 49 of compressed air canister 48 is shown threaded into a manifold 100 located on receptor 102, and having passageway 47 for directing compressed air from the compressed air canister 48 to the air nozzles 80-83. The compressed air canister 48 may use a B188 female aerosol valve available from LINDAL. As shown in the present embodiment, the manifold 100 includes four separate passageways for directed compressed air to each of the four air nozzles 80, 81, 82, and 83. Of course, in an embodiment using additional air nozzles, additional passageways could be provided in manifold 100. A solenoid valve 101 may be used to control the discharge of compressed air through the air nozzles. When the solenoid valve 101 is energized, the passageways in the manifold 100 to the air nozzles are opened and a burst of air is allowed to travel through passageways (hoses) 80*a*, 81*a*, 82*a*, and 83*a* (not shown) to the air nozzles 80, 81, 82, and 83 (not shown). The solenoid valve used for this application may be a Magnum Series 10 mm solenoid valve available from Hargraves. It will be appreciated that that use of a solenoid valve is simply a preferred means for controlling the discharge of compressed air from compressed air canister 48 and that other types of valves or controls could also be used that are suitable for controlling the discharges of compressed air from air canister 48. For example, a rotating cam could be used to release the compressed, or a linear actuator could be used. In addition, a gear motor may also be used and mechanisms that are used to release chemicals in air fresheners may also be used.

Figure 5:
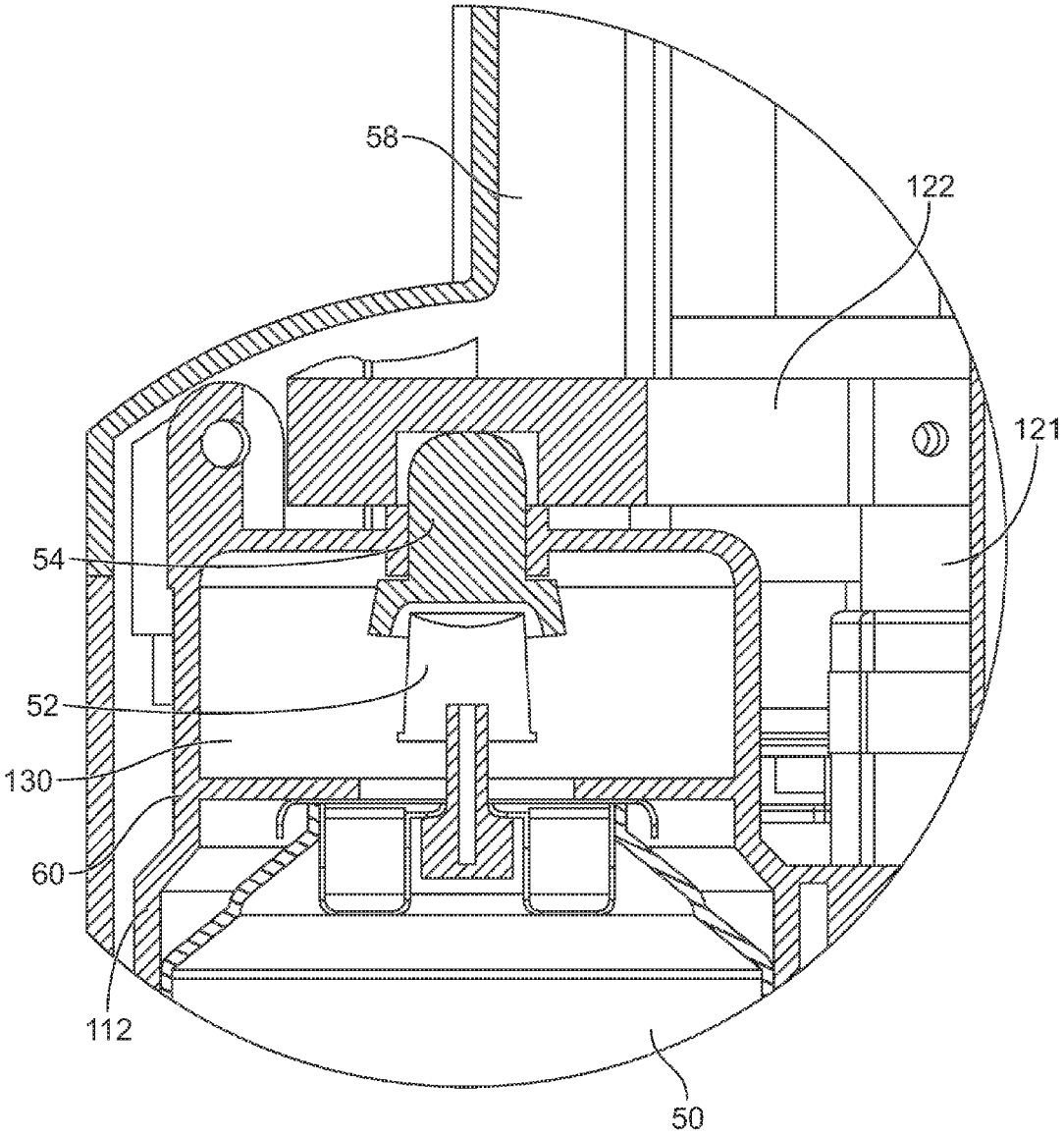
FIG. 5 is an enlarged view of circle F shown in FIG. 3.

FIG. 3 also includes encircled portion F that is shown enlarged in FIG. 5. As shown in FIGS. 3 and 5, a linear actuator 120 positioned within pocket 123 is used to control the discharge of carbon monoxide test gas or gas for testing a smoke detector from test canister 50. In particular, linear actuator 120 includes an arm 121 that is drawn into the linear actuator 120 when the linear actuator is energized. Arm 121 is connected to lever 122, such that when linear actuator 120 is energized, arm 121 is drawn into the linear actuator 120 and lever 122 is caused to push depressor 54 into contact with aerosol trigger 52 and depress aerosol trigger 52 to cause carbon monoxide test gas or gas for testing smoke detectors to be released from test canister 50. The test gas is released into chimney 60 where it travels through passageway 130 of chimney 60 that provides a pathway between test canister 50 and detector chamber 16. In this manner, test gas may be released and introduced into detector chamber 16 to test whether the detecting capabilities of a carbon monoxide detector or a smoke detector are working properly. In a preferred embodiment, an L12 series linear actuator from Firgelli may be used to control the release of test gas from test canister 50. It will be appreciated that that use of a linear actuator is simply a preferred means for controlling the discharge of test gas from test canister 50 and that other types of valves or controls could also be used that are suitable for controlling the discharges of test gas from test canister 50. For example, a rotating cam could be used to release the compressed, or solenoid valve could be used. In addition, a gear motor may also be used and mechanisms that are used to release chemicals in air fresheners may also be used.

FIG. 4 shows an alternate cutaway view of the detector cleaning and/or testing device 10 shown in FIGS. 1-3. A different view of detector chamber 16 is shown with air nozzles 80, 81, and 83 and passageways 80*a*, 81*a*, and 83*a* shown. A fan 28 is shown positioned beneath air filter 25, and dust drawer 24. When contacting surface 18 is positioned to enclose a detector to be cleaned or tested, the fan is used to create a vacuum that draws air, and any dust or debris dislodged during the cleaning operation, from detector chamber 16, and into air filter 25. Air filter 25 filters out dust and debris from the air which is collected in dust bin 123 of dust drawer 24. The dust drawer 24 may be periodically removed to empty the dust and debris from dust bin 123 positioned on dust drawer 24. The use of the dust drawer 24 with dust bin 123 allows any dust or debris dislodged during the cleaning operation to be collected and contained within the dust bin 123 so that the area surrounding the detector is not contaminated with dust and debris dislodged during the cleaning operation.

The air filter 25 is preferably a HEPA filter that filters out 99.97% of all particles greater than 0.3 micrometers in size from the air that passes through the filter. The air filter 25 may also be replaced periodically. In addition, the fan may also be used to clear the detector chamber 16 of test gas following a test of a detector within the detector chamber. For example, particulates within a test gas for testing a smoke alarm may be filtered out through air filter 25.

The fan 28 is preferably a pancake style fan that draws the air from detector chamber 16 through air filter 25. In a preferred embodiment, the fan 28 is made by Digikey having part number KDE2406PHS2. Handle 14 is shown having a cavity 15 adapted to receive a pole or other device for extending the detector cleaning and/or testing device into place over a detector positioned on a ceiling, wall, or other surface.

It is known that in the past, when detectors were cleaned, the extent of cleaning could vary widely depending on the technician performing the cleaning, the amount time spent cleaning each detector, the location and positioning of the detectors, etc. The present cleaning device 10 allows for more uniform cleaning of detectors within a certain location or facility. For example, the cleaning is highly repeatable where each detector may be given the identical cleaning treatment. This is desirable so that the time between required cleaning can better be determined.

It will be appreciated by those of skill in the art that the detector cleaning and/or testing device 10 shown in FIGS. 1-6 has the capability of both cleaning a detector as well as testing a carbon monoxide detector or smoke detector. However, the device could be limited to only a cleaning device or only a testing device, and does not require that the device is capable of both. The present embodiments simply disclose how a device that cleans and tests could be incorporated into a single device, but that is not required.

Example embodiments of the present invention have been described above. Those skilled in the art will understand that changes and modifications may be made to the described embodiments without departing from the true scope and spirit of the present invention, which is defined by the claims.

We claim:

1. An apparatus for cleaning a detector comprising:

a housing;

a bowl positioned on an upper portion of the housing and having an open upper surface, said bowl having a detector chamber adapted for enclosing a detector to be cleaned;

a contacting surface positioned on the bowl;

one of more air nozzles positioned within the detector chamber for directing one or more bursts of compressed air at a detector when positioned within the detector chamber;

a removable dust collector positioned in the housing for containing dirt or debris dislodged from a detector during a cleaning operation;

an air filter positioned within the dust collector;

a fan positioned within the housing and beneath the dust collector operable to draw air within the detector chamber into the air filter; and means for introducing test gas into the detector chamber.

2. The apparatus of claim 1, wherein a container of compressed air is positioned within the housing.

3. The apparatus of claim 2, wherein the container of compressed air is threaded into a receptor that is positioned within the housing.

4. The apparatus of claim 2, further including a manifold in communication with the container of compressed air, the manifold having a plurality of passages for directing compressed air to a plurality of the one or more of the air nozzles positioned in the detector chamber.

5. The apparatus of claim 4, wherein a valve is operable to control the flow of compressed air through the manifold.

6. The apparatus of claim 5, wherein the valve is a solenoid valve.

7. The apparatus of claim 2, including means for releasing compressed air from the container of compressed air.

8. The apparatus of claim 1, wherein one of the one or more nozzles is positioned directly beneath a detector, and pointed directly at the detector, when a detector is positioned within the detector chamber.

9. The apparatus of claim 8, wherein three air nozzles are positioned within the detector chamber and directed at an angle towards a detector when a detector is positioned within the detector chamber.

10. The apparatus of claim 9, wherein the angle is 45 degrees.

11. The apparatus of claim 9, wherein the three air nozzles are spaced apart 120 degrees from each other.

12. The apparatus of claim 1, wherein a container of test gas is positioned within the housing.

13. The apparatus of claim 1, wherein a latch is used to hold the container of test gas in position.

14. The apparatus of claim 12, wherein a linear actuator is positioned adjacent the container of test gas for controlling the discharge of test gas from the container of test gas.

15. The apparatus of claim 14, wherein a lever is attached to an arm of the linear actuator such that, when the linear actuator is energized, the lever causes a depressor to depress a trigger on the container of test gas and release test gas from the container of test gas.

16. The apparatus of claim 12, wherein when test gas is released from the container of test gas, the test gas passes through a chimney into the detector chamber.

17. The apparatus of claim 1, wherein when the contacting surface is pressed against a ceiling or wall, a contact switch is depressed which switches the apparatus to a ready mode of operation.

18. The apparatus of claim 16, wherein the test gas contains carbon monoxide.

19. The apparatus of claim 16, wherein the test gas contains smoke or synthetic smoke.

20. The apparatus of claim 1, wherein a container of compressed air is threadingly engaged to a manifold positioned within the housing.

21. The apparatus of claim 1, further comprising:

a container of test gas positioned within the housing; and a passageway within the housing for test gas to enter the detector chamber;

wherein the fan positioned within the housing is operable to draw test gas from the detector chamber into the air filter that is positioned in the housing above the fan.

22. A method of cleaning a detector comprising the steps of:

providing an apparatus having a housing, a bowl positioned on an upper portion of the housing and having an open upper surface, said bowl connected to the housing having a detector chamber adapted for enclosing a detector to be cleaned, a contacting surface positioned on the bowl, one of more air nozzles positioned within the detector chamber for directing one or more bursts of compressed air at a detector when positioned within the detector chamber, a dust collector positioned in the housing for containing dirt or debris dislodged from a detector during a cleaning operation, an air filter positioned within the dust collector, a fan positioned within the housing and beneath the dust collector operable to draw air within the detector chamber into the air filter, and means for introducing test gas into the detector chamber;

positioning the detector chamber over a detector to be cleaned;

pressing the contacting surface positioned on the detector chamber against a surface to which the detector is positioned;

discharging one or more bursts of compressed air through the one or more nozzles positioned in the detector chamber towards the detector to clean dust or debris from the detector;

operating the fan to draw air from the detector chamber into the air filter;

collecting dust or debris dislodged from the detector in the dust collector.

23. The method of claim 22, wherein the step of discharging one or more bursts comprises discharging three bursts of compressed air for a duration of around a half second from each of the one or more nozzles.

24. The method of claim 22, wherein the step of discharging one or more bursts comprises discharging at least one burst of compressed air for a duration of one second or less from the one or more nozzles.

25. The method of claim 22, wherein the discharge of one or more bursts of compressed air is controlled by a valve that controls the flow of compressed air through one or more passageways of a manifold positioned on the container of compressed air.

26. The method of claim 25, wherein the manifold includes four passageways that direct air to four air nozzles positioned in the detector chamber.

27. The method of claim 26, wherein one of the four air nozzles is positioned directly beneath the detector in the detector chamber.

28. The method of claim 27, wherein the other three nozzles are positioned within the detector chamber to direct compressed air towards the detector at an angle.

29. The method of claim 28, wherein the angle is 45 degrees.

30. The method claim 28, wherein the three nozzles are spaced apart from each other 120 degrees.

31. The method of claim 25, wherein the valve is a solenoid valve.

32. The method of claim 23, further including the step of releasing a test gas into the detector chamber.

33. The method of claim 32, wherein the step of releasing the test gas includes operating a linear actuator to move a lever attached to the linear actuator into indirect or direct contact with an aerosol trigger positioned on a container of test gas positioned within the housing.

34. The method of claim 33, wherein a depressor is positioned between the lever and the aerosol trigger.

35. The method of claim 32, wherein the test gas contains carbon monoxide.

36. The method of claim 32, wherein the test gas contains smoke or synthetic smoke.

37. The method of claim 32, further including the step of operating a fan to remove test gas from the detection chamber and into the filter.

38. A method of cleaning and testing a detector comprising the steps of:

providing a housing, a bowl positioned on an upper portion of the housing and having an open upper surface, said bowl connected to the housing having a detector chamber adapted for enclosing a detector to be tested, a contacting surface positioned on the bowl, a passageway within the housing for test gas to enter the detector chamber, one of more air nozzles positioned within the detector chamber for directing one or more bursts of compressed air at a detector when positioned with the detector chamber, a fan positioned within the housing and beneath the dust collector operable to draw test gas from the detector chamber into an air filter that is positioned in the housing above the fan, said fan also operable to draw air within the detector chamber into the air filter positioning the detector chamber over a detector to be cleaned;

discharging one or more bursts of compressed air through the one or more nozzles positioned in the detector chambers towards the detector to clean dust or debris from the detector;

operating the fan to draw air from the detector chamber into the air filter;

releasing test gas into the detector chamber; and operating fan to draw the test gas from the detector chamber into the air filter.

39. The method of claim 38 further including the step of collecting any dust or debris dislodged from the detector and particulates from the test gas in a dust bin positioned within the housing.

40. The method of claim 38, wherein the test gas contains carbon monoxide.

41. The method of claim 38, wherein the test gas contains smoke or synthetic smoke.

42. An apparatus for testing a detector comprising:

a housing;

a bowl positioned on an upper portion of the housing and having an open upper surface, said bowl connected to the housing having a detector chamber adapted for enclosing a detector to be tested;

a contacting surface positioned on the bowl;

a passageway within the housing for test gas to enter the detector chamber;

one of more air nozzles positioned within the detector chamber for directing one or more bursts of compressed air at a detector when positioned within the detector chamber;

a fan positioned within the housing and beneath the dust collector operable to draw test gas from the detector chamber into an air filter that is positioned in the housing above the fan said fan also operable to draw air within the detector chamber into the air filter.

43. The apparatus of claim 42, wherein a container of test gas is positioned within the housing.

44. The apparatus of claim 43, including means for releasing test gas from the container of test gas.

45. The apparatus of claim 43, further including a test container receptor within the housing adapted for receiving the container of test gas.

46. The apparatus of claim 43, wherein a linear actuator is positioned adjacent the container of test gas for controlling the discharge of test gas from the container of test gas.

47. The apparatus of claim 46, wherein a lever is attached to an arm of the linear actuator such that, when the linear actuator is energized, the lever causes a depressor to depress a trigger on the container of test gas and release test gas from the container of test gas.

* * * * *

UNITED STATES PATENT AND TRADEMARK OFFICE

CERTIFICATE OF CORRECTION

PATENT NO. : 8,973,211 B2
APPLICATION NO. : 13/366309
DATED : March 10, 2015
INVENTOR(S) : Scott Rote, Dan Johnson and Aaron B. Eiger It is certified that error appears in the above-identified patent and that said Letters Patent is hereby corrected as shown below:

In the Claims

In claim 1, column 9, line 13, delete the word "removable" before the term "dust collector"

In claim 38, column 11, line 33, delete the word "with" after the word "positioned" and replace it with the word "within"

In claim 38, column 11, line 35, delete the word "the" before the term "dust collector" and replace it with the word "a"

In claim 38, column 12, line 2, insert the word --the-- between the word "operating" and the word "fan"

In claim 42, column 12, lines 16 and 17, delete the phrase "connected to the housing"

In claim 42, column 12, line 26, delete the word "the" after the word "beneath" and before the term "dust collector" and replace it with the word "a"

In claim 42, column 12, line 29, insert a --,-- after the phrase "above the fan"

Signed and Sealed this
Twenty-eighth Day of July, 2015

Michelle K. Lee

Michelle K. Lee
*Director of the United States Patent and Trademark Office*